United States Patent [19]

Taha

[11] Patent Number: 4,853,259

[45] Date of Patent: Aug. 1, 1989

[54] PROCESS FOR MANUFACTURING PARTICULATE BUILT NONIONIC SYNTHETIC ORGANIC DETERGENT COMPOSITION COMPRISING POLYACETAL CARBOXYLATE AND CARBONATE AND BICARBONATE BUILDERS

[75] Inventor: Riad A. Taha, Spotswood, N.J.

[73] Assignee: Colgate-Palmolive Company, Piscataway, N.J.

[21] Appl. No.: 142,384

[22] Filed: Jan. 11, 1988

Related U.S. Application Data

[63] Continuation of Ser. No. 616,461, Jun. 1, 1984, Pat. No. 4,720,399.

[51] Int. Cl.[4] ..... B05D 7/00; C11D 17/00

[52] U.S. Cl. ..... 427/221; 252/91; 252/174.14; 252/174.21; 252/174.24; 252/174.25; 252/174; 252/135; 252/140

[58] Field of Search ..... 252/89, 95, 98, 99, 252/187 C, 174.21, 140, 91, 174.13, 174.14, 174.21, 174.25, 174.24; 427/220, 221

[56] References Cited

U.S. PATENT DOCUMENTS

| | | | |
|---|---|---|---|
| 4,144,226 | 3/1979 | Crutchfield et al. | 252/174.24 |
| 4,260,651 | 4/1981 | Wixon | 252/140 |
| 4,315,092 | 2/1982 | Crutchfield et al. | 560/180 |
| 4,720,399 | 1/1988 | Taha | 427/221 |

FOREIGN PATENT DOCUMENTS 0021491 6/1980 European Pat. Off. .

*Primary Examiner*—A. Lionel Clingman

*Assistant Examiner*—John F. McNally

*Attorney, Agent, or Firm*—Murray M. Grill; Robert C. Sullivan

[57] ABSTRACT

A particulate built nonionic synthetic organic detergent composition includes a detersive proportion of a nonionic synthetic organic detergent and a building proportion, in combination, of a polyacetal carboxylate builder for the nonionic detergent and carbonate and bicarbonate builders for such nonionic detergent. Such compositions are readily made by adding polyacetal carboxylate builder to the formula of a control detergent composition, with corresponding diminutions of other component(s), and have detersive powers superior to such control despite the decrease in proportions present of detergent and other builders. Preferably, certain nonionic detergents, polyacetal carboxylate builders, carbonate and bicarbonate, in certain proportions, are employed to make a product of better detergency and physical characteristics, e.g., flowability.

Also disclosed are processes for manufacturing the described detergent compositions, in which processes spray dried builder base beads, containing carbonate and bicarbonate builder salts, have nonionic detergent and polyacetal carboxylate builder mixed with or applied to them. Additionally described are pumpable and sprayable compositions of polyacetal carboxylate builder in normally solid, liquid nonionic detergent at elevated temperature, which compositions are suitable for applying the nonionic detergent and polyacetal carboxylate builder to the spray dried carbonate-bicarbonate base beads, preferably as a spray impinging on moving surfaces of such beads.

6 Claims, No Drawings

PROCESS FOR MANUFACTURING PARTICULATE BUILT NONIONIC SYNTHETIC ORGANIC DETERGENT COMPOSITION COMPRISING POLYACETAL CARBOXYLATE AND CARBONATE AND BICARBONATE BUILDERS

This is a continuation of application Ser. No. 616,461, filed June 1, 1984 now U.S. Pat. No. 4,720,399.

This invention relates to a particulate built nonionic synthetic organic detergent composition. More particularly, it relates to such a composition containing a building proportion, in combination, of polyacetal carboxylate and carbonate and bicarbonate builders for the nonionic detergent. The invention also includes processes for manufacturing such products.

Particulate nonionic detergent products are known wherein base beads, comprised mostly of inorganic builder salt(s), e.g., carbonates and bicarbonates, obtained by spray drying an aqueous crutcher mix or slurry, have normally solid nonionic detergent in liquid state absorbed by them, to produce free flowing particulate compositions. Polyacetal carboxylate builder salts suitable for use as builders with various organic detergents, primarily anionic organic detergents, have been described in the literature and in various U.S. and foreign patents. However, before the present invention, particulate built nonionic synthetic organic detergent compositions containing carbonate and bicarbonate builder salts and polyacetal carboxylate in a total building proportion had not been disclosed and the advantages of such compositions and of processes for their manufacture, wherein the polyacetal carboxylate and nonionic detergent were applied to base beads of carbonate and bicarbonate builder salts, were not known.

Particulate nonionic detergent compositions in which the nonionic detergent is applied in liquid state to porous base beads containing carbonate and bicarbonate builder salts are referred to in U.S. Pat. No. 4,269,722, and such compositions have been marketed under the trademark FRESH START®. They are especially useful as non-phosphate or limited phosphate content detergents in those areas where high phosphate content detergent compositions are prohibited. Polyacetal carboxylates are described in U.S. Pat. Nos. 4,144,226 and 4,315,092. U.S. Pat. Nos. 4,146,495 and 4,219,437 claim detergent compositions containing the polyacetal carboxylate builder (U.S. Pat. No. 4,146,495) and similar compositions containing keto dicarboxylates (U.S. Pat. No. 4,219,437), which can often be employed in replacement of the polyacetal carboxylates. Various other patents on similar builders include U.S. Pat. Nos. 4,141,676; 4,169,934; 4,201,858; 4,204,852; 4,224,420; 4,225,685; 4,226,960; 4,233,422; 4,233,423; 4,302,564; and 4,303,777. Also relevant are European patent applications No's. 0 015 024; 0 021 491; and 0 063 399. Although in some such patents and/or applications there ar included broad teachings that polyacetal carboxylates may be included in various types of detergent compositions, and although some such polyacetal carboxylates are described as components of compositions containing nonionic detergents and cationic softening agents, none of the references or combinations thereof describes or suggests such polyacetal carboxylates as components of the nonionic detergents of the present invention and none teaches the obtaining of the described improved detergency of the invented compositions and the free flowing nature of the products made. Also, the present manufacturing processes are not described or fairly suggested in any such reference or in any combination of the references.

In accordance with the present invention a particulate built nonionic synthetic organic detergent composition comprises a detersive proportion of a nonionic synthetic organic detergent, and a building proportion, in combination, of a polyacetal carboxylate builder for the nonionic detergent and carbonate and bicarbonate builders for the nonionic detergent. Preferably, certain nonionic detergents, polyacetal carboxylate builders, carbonate and bicarbonate builders are utilized in certain proportions and the product obtained is a free flowing particulate built detergent composition of improved detergency (or soil removing properties). Also within the invention are processes for making such particulate detergents.

The polyacetal carboxylate may be considered to be that described in U.S. Pat. No. 4,144,226 and may be made by the method mentioned therein. A typical such product will be of the formula

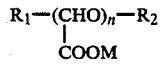

wherein M is selected from the group consisting of alkali metal, ammonium, alkyl groups of 1 to 4 carbon atoms, tetraalkylammonium groups and alkanolamine groups, both of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 50 to 200, $R_1$ is

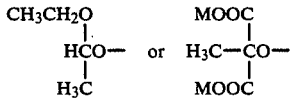

or a mixture thereof, $R_2$ is

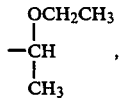

and n averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

Although the preferred polyacetal carboxylates have been described above, it is to be understood that they may be wholly or partially replaced by other such polyacetal carboxylate or related organic builder salts described in the previously cited patents on such compounds, processes for the manufacture thereof and compositions in which they are employed. Also, the chain terminating groups described in the various patents, especially U.S. Pat. No. 4,144,226, may be utilized, providing that they have the desired stabilizing properties, which allow the mentioned builders to be depolymerized in acid media, facilitating biodegradation thereof in waste streams, but maintain their stability in alkaline media, such as washing solutions.

The carbonate and bicarbonate builders are highly preferably sodium salts but other water soluble alkali metal carbonates and bicarbonates may also be employed, at least in part, such as those of potassium. Such may be in anhydrous, hydrated or partially hydrated state. Sodium sesquicarbonate may be used in partial or complete replacements of the carbonate and bicarbonate. One of the advantages of the present invention is that the sodium carbonate found in "Builder U", the available polyacetal carboxylate, is useful as a builder in the detergent compositions made.

The fourth component of the present detergent compositions is a nonionic synthetic organic detergent or a mixture of such detergents. While various suitable nonionic detergents having the desired detersive properties and physical characteristics (normally solid, at room temperature, but liquefiable so as to be capable of being applied to base beads in liquid form) may be employed, at least as a part of such detergent content of the invented compositions. Very preferably the nonionic detergent will be a condensation product of ethylene oxide and a higher fatty alcohol. The ethylene oxide content of such detergents will be within the range of 3 to 20 moles, preferably 3 to 12 moles and more preferably 6 to 8 moles, e.g., about 6.5 or 7 moles of ethylene oxide, per mole of fatty alcohol, and the fatty alcohol will usually be of 10 to 18 carbon atoms, preferably averaging 12 to 15 carbon atoms, e.g., about 13 or 14 carbon atoms. Among other nonionic detergents that are also useful are the ethylene oxide condensation products of alkylphenols of 5 to 12 carbon atoms in the alkyl group, such as nonylphenol, in which the ethylene oxide content is from 3 to 30 moles per mole, and condensation products of ethylene oxide and propylene oxide, sold under the trademark Pluronic®.

Although essentially anhydrous products can be manufactured and are useful, usually moisture will be present in the detergent composition, either in free form or as a hydrate, such as a hydrated carbonate. The presence of such a hydrate helps to strengthen the detergent composition particles and sometimes facilitates dissolving of such particles in the wash water. For such reasons, and to facilitate manufacturing, moisture is preferably present in the product.

In addition to the mentioned components, other materials, such as a supplementing builder (sodium silicate) and adjuvants may be employed. Also, in some cases condensation products of higher fatty alcohol and ethylene oxide of greater ethylene oxide contents than 20 moles per mole may be employed in substitution for some of the condensation products of lesser ethylene oxide content. Thus, if it is desirable to further improve flowability of a preferred product a harder nonionic component, such as one of 21 to 50 ethylene oxide groups per mole, may be utilized in part, in which case it will desirably be from 1 to 50%, usually more preferably from 5 to 25% of the total nonionic detergent content. Also, sodium silicate, which has a supplementing building action and aids in inhibiting corrosion of aluminum items in wash water containing the detergent composition, will be of $Na_2O:SiO_2$ ratio in the range of about 1:1.6 to 1:3, preferably 1:2 to 1:2.6, e.g., 1:2.35 or 1:2.4.

Among the various adjuvants that may be employed are colorants, such as dyes and pigments, perfumes, enzymes, stabilizers, antioxidants, fluorescent brighteners, buffers, fungicides, germicides, and flow promoting agents. If desired, fillers, such as sodium sulfate and/or sodium chloride, may also be present. Also among the "adjuvants" are included various fillers and impurities in other components of the compositions, such as $Na_2CO_3$ in the polyacetal carboxylate (Builder U).

The proportions of the various components that will result in the desired improved detersive properties (previously mentioned) will normally be from 5 to 35% of nonionic detergent, and from 30 to 95% of a combination of polyacetal carboxylate and carbonate and bicarbonate builders. The ratio of the polyacetal carboxylate to combined carbonate and bicarbonate will be in the range of 1:5 to 2:1, preferably 1:5 to 3:2, and more preferably 1:4 to 1:1, e.g., about 1:2.2. Any balances of such compositions will be filler(s), other builder(s), adjuvant(s) and moisture. Usually the nonionic detergent content will be at least 5% of the product and the carbonate plus bicarbonate builders content will be at least 15%, preferably at least 25% thereof. The nonionic detergent content will preferably be 10 to 30%, more preferably 10 to 20%, e.g., about 16%, the polyacetal carboxylate will preferably be 10 to 40%, more preferably 12 to 30%, e.g., about 18 or 23%, and the total of carbonate and bicarbonate will preferably be from 20 to 75%, more preferably 25 to 55%, e.g., about 41%,of the detergent composition. The ratio of carbonate to bicarbonate will be within the range of 1:3 to 3:1, preferably 1:2 to 2:1 and more preferably 1:2 to 1:1, e.g., about 1:1.5. Preferably the percentages of carbonate and bicarbonate will be within the ranges of 10 to 30% and 10 to 40%, respectively, more preferably being 10 to 20% and 15 to 35%, e.g., about 17% and about 24%. The moisture content of the product will usually be from 1 to 20%, preferably 3 to 15% and more preferably from 3 to 8%, e.g., about 4 or 5%. Such moisture content includes that which is removable from the product in standard oven drying (105° C. for two hours). The sodium silicate content, when sodium silicate is present, will be from 1 to 18%, preferably 5 to 15% and more preferably 8 to 14%, e.g., about 13%. The total percentage of adjuvants may range from 0 to 20% but normally will be at the lower end of such range, 1 to 10%, preferably 2 to 6%, e.g., about 4 or 5%, with individual adjuvant percentages usually being from 0.1 to 5%, preferably 0.2 to 3%. In the foregoing description and elsewhere in the specification the percentages of carbonate and bicarbonate given are on an "anhydrous" basis, and do not include moisture that is removable by oven drying, as described above. The content of filler(s) may be as high as 40% in some instances but usually, if filler is present, the proportion thereof will be in the range of 5 to 30%, often 10 to 25%.

The particulate detergent product of this invention may be made by the method described in U.S. Pat. No. 4,269,722. That patent and U.S. Pat. No. 4,144,226 are hereby incorporated by reference. Following such method, an aqueous slurry is made which includes the particulate sodium carbonate and sodium bicarbonate, sodium silicate, usually added as an aqueous solution, water, and any suitable fillers and adjuvants, such as fluorescent brightener and pigment, which are heat stable. Sodium sulfate has been found to adversely affect flowability of the detergent composition, when added to base beads with nonionic detergent, so its presence is sometimes avoided. In some instances the polyacetal carboxylate builder may be added in the crutcher but because it has sometimes been found to be of limited stability when processed at elevated temperature, such builder is often post-added. Generally the crutcher mix is at a solids content in the range of 40 to 70% and is heated to a temperature in the range of 40° to 70° C. Anhydrous or hydrated bicarbonate and carbonate or other suitable combined form thereof, such as sodium sesquicarbonate, may be employed. However, a major proportion of the nonionic detergent component will not be present in the crutcher; instead, it will be postadded, and preferably the proportion of nonionic detergent in the crutcher will be limited to about 4%, preferably 2% or less (on a final product basis), and most preferably, none, so as to avoid loss of such detergent during the spray drying operation. If agitation to produce uniformity of the slurry is difficult, because of excessive gelation or thickening of the mix, viscosity control agents, such as citric acid, magnesium sulfate and/or magnesium citrate may be employed. Such thinning agents will be considered to be within the group designated "adjuvants". After thorough mixing in the crutcher which may take from 10 minutes to an hour, the crutcher slurry is pumped to a conventional spray drying tower, either concurrent or countercurrent, in which it is dried by heated drying air at a temperature in the range of 200° to 500° C., preferably 200° to 350° C. if the mix contains polyacetal carboxylate, to produce globular spray dried particles of sizes in the range of No's. 8 to 100 sieves, U.S. Sieve Series. Such base beads are desirably porous, so as to be capable of absorbing nonionic detergent, and such porosity is due at least in part to the decomposition of bicarbonate to carbonate during spray drying, which produces "puffing" carbon dioxide. Normally, from 20 to 80% of the bicarbonate converts to carbonate, depending on spray tower conditions.

The porous base beads resulting are introduced into a suitable batch or continuous mixer or blender, such as an inclined rotary drum (batch), in which they are post sprayed at a suitable temperature at which the nonionic detergent is liquid, usually in the range of 45° to 60° C., preferably 45° to 50° C. In one embodiment of the invented process all the nonionic detergent, in liquid state and preferably at elevated temperature in the described preferred range, is sprayed onto the moving surfaces of the mass of base beads by means of an atomizing nozzle of conventional type, and during mixing it penetrates into the interiors of the beads, with some of nonionic detergent being near the surface thereof. Then, without cooling to the solidification point of the detergent, the polyacetal carboxylate builder, in finely divided powdered form, as of particle sizes in the range of 200 to 400 mesh (although coarser particles as large as No. 100, U.S. Sieve Series, may also be used), is dusted onto the moving base beads, which now contain absorbed nonionic detergent. Some of the finely divided polyacetal carboxylate particles are drawn into the interstices and cavities of the beads by the still liquid nonionic detergent and others adhere to such detergent near the surfaces of the beads, and are held to the beads as the detergent is cooled to solidification. In such operation the polyacetal carboxylate which is held to the base beads inhibits the production of tacky product. At the same time, the holding of it to the beads prevents stratification of the product in its end use package during shipment and storage.

Various adjuvants of the types that would normally be post-added, such as enzyme powders and perfumes, may be added with the polyacetal carboxylate powder or before or after the powder addition. Usually, as with the nonionic detergent, it is preferred to spray liquid components onto the surfaces of the intermediate detergent composition particles but in some instances, as is also the case with application of the nonionic detergent in liquid state to the base beads, spraying is unnecessary and dripping of the liquid also serves to distribute it satisfactorily and to promote absorption of it into the porous particles. Powdered materials being added are preferably in finely divided powdered form, as described above for the polycarboxylate builder, but other particle size ranges may also be utilized (as they may be for the builder), although in such cases the results may not be as satisfactory. Also, instead of spraying the liquid material onto spray dried base beads for absorption, in some instances one may apply the liquid to granular (not spray dried or agglomerated) mixed carbonate and bicarbonate particles, but such is not usually as satisfactory because such particles do not normally have the absorbing capacity of spray dried base beads and are less uniform.

Instead of having post-applied powdered polyacetal carboxylate particles adhered to liquid detergent that has been applied to base beads, in another and preferred process of this invention the builder is applied to the base beads as a dispersion of the polyacetal carboxylate in the normally solid nonionic detergent at elevated temperature and in liquid state. In such application, some of the polyacetal carboxylate builder may be dissolved in the liquid nonionic detergent but normally more of it is dispersed therein, preferably in finely divided particles, such as those smaller than 200 mesh, and preferably larger than 400 mesh. In such applications the base beads may be heated initially to a temperature like that of the liquid state detergent being applied but it has been found that although theoretically such an operation would be thought to promote greater absorption of the detergent and polyacetal carboxylate builder, in practice it is sufficient for the base beads to be at room temperature, at which satisfactory absorption and quick cooling of the product result. The dispersion of polyacetal carboxylate builder particles in liquid state nonionic detergent is preferably sprayed onto a moving bed of base beads but sometimes spraying is unnecessary, and mere dripping of the liquid medium onto the base beads is satisfactory, and in some instances it is enough merely to admix the base beads and the dispersion together without any concern for the mode of application of the liquid dispersion to the base beads being required.

The temperature of the dispersion of polyacetal carboxylate particles in a nonionic detergent may be such as has been found to be suitable for use in the application process described. Normally such temperature will be in the range of 45° to 95° C. but preferably, so as better to maintain stability of the polyacetal carboxylate and to promote quicker cooling after application thereof to the base particles, the temperature of application will be in the range of 45° to 60° C., most preferably about 45° to 50° or 55° C. However, this depends on the solidification point of the nonionic detergent, which will be the same as or lower than the lowest temperature of such a range. Of course, with higher melting nonionic detergents the lower limit of the range will be adjusted accordingly, usually being at least 2° and preferably at least 5° or 10° higher than the solidification point. The polyacetal carboxylate will preferably be of particle sizes, substantially all (usually more than 90%, preferably more than 95% and more preferably more than 98%) of which are no larger than that which will pass through a No. 200 sieve, U.S. Sieve Series (or a 200 mesh sieve). However, larger sized particles may be employed but generally such are not larger than 100 or 160 mesh. Preferably the particles will be in the 200 to 400 mesh range, e.g., 200 to 325 mesh, to promote penetrations into interstices of the base beads and to promote better holdings to the surfaces thereof.

In the dispersions mentioned, in which some of the polyacetal carboxylate may be in solution, the proportion of polyacetal carboxylate to nonionic detergent will normally be in the range of 1:20 to 3:2, preferably 1:10 to 1:1 and more preferably 1:2 to 1:1. However, such proportions may be adjusted, depending on the formula proportions of the polyacetal carboxylate and nonionic detergent desired to be in the end product. Still, normally no more than three parts of polyacetal carboxylate will be present with two parts of nonionic detergent, and preferably such upper limit will be 1:1. If more polyacetal carboxylate is desired in the product formula it may be post-applied, as previously described, after absorption of some of the polyacetal carboxylate and the liquid state nonionic detergent. While other materials, including particulate materials, such as enzymes, may be post-added, sometimes they may also be dissolved and/or dispersed in the nonionic detergent, with the polyacetal carboxylate and may be applied to the base beads together with such builder and detergent.

In some cases, some (sometimes all) of the polyacetal carboxylate may be spray dried with the carbonate and bicarbonate builders but in such instances the employment of mild conditions will be desired, with special care being taken not to allow buildup of product on the spray tower interior walls, where the polyacetal carboxylate could be decomposed. So long as the spray tower conditions are such that the bead temperatures do not rise to a destabilizing temperature for the polyacetal carboxylate employed, spray drying is feasible but because this cannot always be assured in commercial spray drying processes, as a practical matter it is often preferable to post-apply the polyacetal carboxylate.

The product of the formulations given, produced by any of the methods described, is satisfactorily free flowing, non-tacky and non-caking despite its contents of nonionic detergent and polyacetal carboxylate. The particles thereof are regular in shape, approximating the spherical, and the product is of desired bulk density (higher than the bulk density of usual spray dried products, which tends to be in the range of 0.25 to 0.4 g./ml.), normally being in the range of about 0.5 to 0.8 g./ml., such as 0.6 to 0.7 g./ml. Thus, smaller packages may be employed, creating more available supermarket shelf space and facilitating home laundry storage. The detergent composition made is an excellent detergent, with improved cleaning power against a variety of soils. Its detergency is greater than that of a control detergent without the polyacetal carboxylate. Surprisingly, the detergency of the present compositions is better than that of a control, despite the fact that the proportion of nonionic detergent in the control is higher. It should be pointed out that the total ratio of builder is greater in the "experimental" product, but then too, the ratios of carbonate, bicarbonate and silicate builders are lower.

The following examples illustrate but do not limit the invention. Unless otherwise indicated all temperatures are in ° C. and all parts are by weight in the examples, elsewhere in the specification, and in the claims.

EXAMPLE 1

| Component | Parts |
|---|---|
| Sodium carbonate (anhydrous) | 16.6 |
| Sodium bicarbonate | 24.7 |
| Higher fatty alcohol polyethoxylate nonionic detergent[1] | 15.2 |
| Sodium polyacetal carboxylate [Builder U][2] | 23.1 |
| Sodium silicate solids ($Na_2O:SiO_2$ = 1:2.4) | 12.9 |
| Moisture | 4.6 |
| Enzyme powder (proteolytic enzyme, 200 mesh) | 1.02 |
| Fluorescent brightener (Tinopal 5BM Conc.) | 1.53 |
| Blue pigment (ultramarine blue) | 0.16 |
| Perfume | 0.19 |
| | 100.0 |

[1]Condensation product of 6.5 moles of ethylene oxide and one mole of higher fatty alcohol of 12-13 carbon atoms sold as Neodol 23-6.5 by Shell Chemical Company
[2]Supplied by Monsanto Company (as Builder U), having a calculated weight average molecular weight of about 8,000, and of about 80% active polymer content.

The particulate detergent composition of the above formula is made by spray drying some of the formula, including the sodium carbonate and sodium bicarbonate to produce base beads, and then post-blending with such base beads other components of the formula, including the nonionic detergent, polyacetal carboxylate, enzyme and perfume. The crutcher mix or slurry is made by sequentially adding to a detergent crutcher 35.6 parts of water (preferably deionized water but city water of up to 150 p.p.m. $CaCO_3$ equivalent may be employed), 7.0 parts of natural soda ash, 32.3 parts of industrial grade sodium bicarbonate, 23.6 parts of a 47.5% aqueous solution of sodium silicate of $Na_2O:SiO_2$ ratio of about 1:2.4, 1.3 parts of fluorescent brightener (Tinopal 5BM Conc.) and 0.3 part of ultramarine blue pigment, and mixing at a temperature of about 45° C. during such additions and for about 20 minutes thereafter, after which the crutcher slurry, of a solids content of about 45%, is dropped to a high pressure pump which pumps it through atomizing nozzles at the top of a countercurrent spray drying tower, in which heated drying air at a temperature of about 325° C. dries it to essentially globular porous particles of sizes in the No's. 10 to 100 sieves (U.S. Sieve Series) range, and of a moisture content of about 7.6%. In some instances a minor proportion of recycled base beads (or final product) may be included in the crutcher mix for reworking, with appropriate modifications of the formula to allow for such.

The base beads resulting, usually at about room temperature but in some cases still at a temperature between the tower bottom air temperature and room temperature, nearer to room temperature (sometimes 5° to 30° C. above it), are charged to a blending apparatus, in this case an inclined rotary drum, in which there are successively added to 78.41 parts of the base beads, 20.02 parts of the ethoxylated alcohol nonionic detergent, 30 parts of Builder U, 0.32 parts of enzyme and 0.25 part of perfume. The ethoxylated alcohol is sprayed onto the moving bed of base beads at an elevated temperature, 50° C., at which it is in liquid state. The Builder U and proteolytic enzyme (mixtures of amylolytic and proteolytic enzymes, e.g., 1:1 mixtures, may also be used) are "dusted" onto the moving bed of base beads after absorption thereby of the nonionic detergent (which usually occurs within about 2 to 10 minutes), after which the perfume is sprayed onto such moving intermediate product. The particulate detergent composition resulting is of particle sizes in the range of No's. 10 to 100 sieves, U.S. Sieve Series, and is of a bulk density of 0.65 g./ml. At room temperature it is free flowing, non-tacky and non-caking. After cooling and screening, if that is desired, to obtain all or substantially all of the particles in the desired No's. 10 to 100 sieve range, the product is packed, cased, warehoused and shipped. It is found to be of uniform composition throughout the package and the contents of various packages are also uniform. It is also non-settling during shipping and storage.

A comparative product is made in the same manner as previously described except for the omission of the sodium polyacetal carboxylate (Builder U) from it. Thus, instead of 100.0 parts of product, 76.9 parts are made, and the proportions of the various components in the product are 30% greater than those given in the above formula. When the "experimental" product is tested against the "control" for detergency, in a standard soil removal test which utilizes different soils deposited on a variety of substrate fabrics, the invented product is found to be significantly better in soil removal activity (or detergency) than the control.

In the detergency tests employed an automatic washing machine containing 67 liters of water at 49° C. has charged to it four pounds of clean clothes and three swatches each of five different test fabrics. The first and second such test fabrics are obtained from Test Fabric Company. The first has a soil of graphite, mineral oil and thickener on nylon and the second has a soil of sebum, particulate material and kaolin on cotton. The third test fabric is cotton soiled with New Jersey clay and the fourth fabric is a cotton-dacron blend soiled with such clay. The fifth test fabric, identified as EMPA 101, is of cotton and it is soiled with a mixture of sebum soil, carbon black and olive oil.

After washing of sets of the test fabric swatches, one set being washed in an automatic washing machine, to the wash water of which the invented composition has been charged, with the concentration thereof in the wash water being 0.07%, the wash water being of a hardness of about 150 p.p.m., calcium carbonate equivalent (Ca:Mg ratio of 3:2), and with the time for the washing portion of the cycle being about 10 minutes, and the other set, to the wash water of which the control composition has been charged, being washed subsequently in the same machine, and after dryings, reflectances of the swatches are measured and the averages for each soiled test fabric are taken. Utilizing different factors that have been found by experience to be representative of human evaluations of the importance of a detergent's cleaning powers against the various soils, the final soil removal indices are obtained for the experimental and control detergent compositions. The soil removal index for the invented product is 12.6 points higher than that for the control, indicating a significant improvement in detergency for the invented composition.

When, in the formulation of the invented product other nonionic detergents are employed, such as Neodol® 25-7, Alfonic® 1618-65, or a suitable ethylene oxide-propylene oxide condensation product such as those marketed under the trademark Pluronic®, similar improved detergency results, compared to a control from which the polyacetal carboxylate has been omitted. Also, when parts of the sodium carbonate and sodium bicarbonate are replaced by equivalent sesquicarbonate, e.g., 10 to 50%, comparable results are obtained. This is also the situation when the silicate employed is of $Na_2O:SiO_2$ ratio of about 1:2. Changes in the adjuvants utilized, such as omission of the enzyme or replacement of it with amylolytic enzyme, or addition of relatively small proportions of filler, such as NaCl and $Na_2SO_4$, or the presence of other builders, such as zeolites, will result in the invented products also showing the described type of improvement over the control. This is also true when different polyacetal carboxylates, such as those of potassium, ammonium, lower alkyl and alkanolamine are present, of 1 to 4 carbon atoms in the alkyls thereof, when the end terminating groups employed are others than the present ones, given in the preceding formula, such others being those described in U.S. Pat. No. 4,144,226, and when the calculated weight average molecular weights of the polyacetal carboxylate are 5,000 or other weights within the described preferred range of 3,500 to 10,000. Of course, when the less desirable components are employed the difference in detergency may not be as great.

Similarly, comparable results are obtained when the manufacturing of the product is effected in other ways, under different conditions, as previously described, and utilizing components in different proportions, also as previously described. For example, when the composition of the formula is varied by changing the proportions of components ±10, ±20 and ±30%, while maintaining them within the ranges given, similar results are obtained.

EXAMPLE 2

Ten parts of Neodol 25-7 (a condensation product of 7 moles of ethylene oxide and one mole of higher fatty alcohol of 12 to 15 carbon atoms, on the average), and ten parts of Builder U, of calculated weight average molecular weight of about 8,000, are converted to a liquid state dispersion-solution by first mixing them together and then heating to about 49° C. The builder powder, of particle sizes in the range of 325 to 400 mesh, does not dissolve in the hot nonionic detergent but disperses well therein. The dispersion thus made is applied as a spray to or is dripped (or sprayed) onto, at an elevated temperature within the range of 45° to 55° C., preferably about 50° C., 30 parts of base beads (in a moving bed) comprising 47% of sodium bicarbonate, 34% of sodium carbonate, 13% of sodium silicate ($Na_2O:SiO_2=1:2.4$), 1.6% of magnesium sulfate, 0.6% of sodium citrate (thinner), and 3.8% of water. The product resulting is free flowing, non-caking and non-tacky, and is of excellent appearance. When tested against a control, from which the Builder U has been omitted, it is found to be of significantly better detergency.

Similar results are obtainable when other carbonates, bicarbonates nonionic detergents and polyacetal carboxylates are employed, and in different proportions, within the descriptions previously given.

To improve flowability, non-tackiness and non-caking properties further, if desired, there may be dusted onto the beads, after absorption of the nonionic detergent and Builder U, about 5 parts of finely divided Zeolite 4A or other suitable zeolite, or the zeolite, of particle sizes like those of the builder, may also be dispersed in the nonionic detergent and applied to the base beads with the nonionic and builder. If zeolite is employed (and it may be spray dried with the polyphosphate or dispersed in the nonionic detergent, too) it will preferably be a Zeolite A (4A is most preferred) of particle size of 200 to 400 mesh, preferably 325 to 400 mesh (if dispersed in nonionic or post-applied) and the proportion thereof will be from 5 to 40%, preferably 10 to 20%, and the zeolite:nonionic ratio will be from 1:20 to 1:1. The ratio of the sum of zeolite and polyacetal carboxylate to nonionic detergent will preferably be in the range of 1:10 to 1.1:1 or 1.2:1.

EXAMPLE 3

The procedure of Example 2 is repeated but the composition is made by applying the Neodol 25-7, in liquid state, at a temperature of 49° C., to the moving base beads by dripping (or spraying) it thereon, after which a finely divided Builder U powder (200 to 400 mesh) is admixed with the intermediate product. The powder adheres to the surface of the nonionic detergent and the product resulting is free flowing, non-tacky, non-caking and non-settling on storage, although without the addition of the Builder U the particles are tacky and lazy. The detergency of the final product is essentially the same (superior), compared to a control, as that of the same composition of Example 2.

Variations in the formula of Examples 2 and 3 may be made, as by utilizing different nonionic detergents, such as those which have been described previously, and polyacetal carboxylates of other types, previously mentioned. Variations also can be made in the base bead formulations, as have been described earlier. In all such instances, the product resulting will be satisfactory and will be of improved detergency, compared to a control from which the polyacetal carboxylate component has been omitted. In some instances, as when the proportion of Builder U and/or nonionic detergent employed is sufficiently high so that flowability could desirably be improved, flow improving agents (zeolite builders can perform such function) may be incorporated in the final product, preferably by mixing them with the Builder U and applying the mixture thereof to the base beads, already containing deposited nonionic detergent in liquid state and at elevated temperature, or by applying the flow-improving agent after absorption by the base beads of the nonionic detergent-polyacetal carboxylate dispersion. Alternatively, some zeolite, e.g., 10 to 20% of the product, may be dispersed in the nonionic detergent, too.

The mixing procedures and apparatuses may be changed too. For example, instead of mixing for twenty minutes in a batch process employing an inclined drum, mixing time may be changed to from 5 to 40 minutes, and other apparatuses may be used, such as V-blenders, fluid beds, Schugi mixers and Day mixers. The results from such changes will still be acceptable product of the desired characteristics and washing properties, with a desired bulk density being in the range of 0.6 to 0.8 g./ml., as in these working examples.

The invention has been described with respect to various illustrations and working embodiments thereof but it is to be understood that it is not limited to these because one of skill in the art, with the present specification before him or her, will be able to utilize substitutes and equivalents without departing from the invention.

What is claimed is:

1. A process for manufacturing a particulate built nonionic synthetic organic detergent composition comprising a detersive proportion of nonionic synthetic organic detergent, and a building proportion, in combination, of polyacetal carboxylate, alkali metal carbonate and alkali metal bicarbonate builders for the nonionic detergent, which process comprises spray drying an aqueous crutcher mix of alkali metal carbonate and alkali metal bicarbonate, mixing the spray dried beads resulting with the nonionic detergent in liquid form at elevated temperature, whereby the detergent is absorbed into the spray dried carbonate-bicarbonate beads, and mixing such beads containing the nonionic detergent with the polyacetal carboxylate builder, whereby said builder is held to such beads and a free flowing particulate detergent composition results.

2. A process for manufacturing a detergent composition according to claim 1 which comprises spray drying an aqueous crutcher mix of alkali metal carbonate and alkali metal bicarbonate, mixing the spray dried beads resulting with the nonionic detergent in liquid form at elevated temperature, whereby the detergent is absorbed into the spray dried carbonate-bicarbonate beads, and mixing such beads containing the nonionic detergent with the polyacetal carboxylate builder, whereby said builder is held to such beads and a free flowing particulate detergent composition results.

3. A process according to claim 1 which comprises dissolving and/or dispersing the polyacetal carboxylate builder in the nonionic detergent in liquid form at elevated temperature, spray drying an aqueous crutcher mix of the alkali metal carbonate and alkali metal bicarbonate, and applying to the spray dried beads resulting the polyacetal carboxylate builder-nonionic detergent solution or dispersion, with mixing, whereby such solution or dispersion is sorbed by the carbonate-bicarbonate beads, producing a free flowing particulate detergent composition.

4. A process according to claim 1 which comprises applying finely divided zeolite to the resulting product, to cover the carboxylate builder and the nonionic detergent, so as to improve the free flowing characteristics of the product.

5. A process according to claim 3 which comprises applying finely divided zeolite to the resulting product, to cover the carboxylate builder and the nonionic detergent, so as to improve the free flowing characteristics of the product.

6. A process according to claim 3 wherein finely divided zeolite particles are dispersed in the nonionic detergent with the polyacetal carboxylate builder and are applied to the spray dried beads with such detergent and builder.

* * * * *